US007320354B2

(12) United States Patent
Cheng

(10) Patent No.: US 7,320,354 B2
(45) Date of Patent: Jan. 22, 2008

(54) PULLING CORD WINDING APPARATUS FOR WINDOW SHADES

(76) Inventor: Li-Ming Cheng, No. 215, Jiouru 1st Rd., Sanmin District, Kaohsiung City (TW)

( * ) Notice: Subject to any disclaimer, the term of this patent is extended or adjusted under 35 U.S.C. 154(b) by 342 days.

(21) Appl. No.: 11/049,739

(22) Filed: Feb. 4, 2005

(65) Prior Publication Data

US 2006/0175023 A1 Aug. 10, 2006

(51) Int. Cl.
*E06B 9/30* (2006.01)

(52) U.S. Cl. ..... 160/170

(58) Field of Classification Search ..... 160/170, 160/171, 178.1 R, 168.1 R, 173 R, 178.2; 242/372, 378.4, 381, 381.3, 381.6, 385.3, 242/385.4

See application file for complete search history.

(56) References Cited

U.S. PATENT DOCUMENTS 794,937 A * 7/1905 Hopkins ..... 160/279
6,024,154 A 2/2000 Wang et al.
6,575,223 B1 6/2003 Chung et al.
6,823,925 B2 * 11/2004 Militello et al. ..... 160/170
2005/0205219 A1 * 9/2005 Hsu ..... 160/170

* cited by examiner

*Primary Examiner*—Blair M. Johnson
(74) *Attorney, Agent, or Firm*—Birch, Stewart, Kolasch & Birch, LLP

(57) ABSTRACT

A pulling cord winding apparatus for window shades is installed on a bottom rail of a window shade includes a upper cap and a lower seat, two elastic take-up reels, two elastic coils held in the elastic take-up reels having two ends latched thereon, an elastic reed bridged a post located on one side of the center housing compartment and each of two brake elements; and a push rod located between two brake elements to form a forced contact. The push rod is depressible forwards and retractable rearwards to retract and press the brake elements to allow a coarse surface formed on an outer side of the brake elements to be spaced from or compressed on the two elastic take-up reels to form a braking or rotating condition and allow the two elastic coils to be retracted or extended to extend or retract the window shade to a selected location.

14 Claims, 10 Drawing Sheets

PULLING CORD WINDING APPARATUS FOR WINDOW SHADES

FIELD OF THE INVENTION

The present invention relates to a pulling cord winding apparatus for window shades that includes a ramming element attached to one side of a push rod and two brake elements that may be pressed together or separated, and the brake elements have a coarse surface to facilitate pressing and positioning so that two wound elastic coils housed respectively in a housing space of two take-up reels can provide a torsional returning force to extend or retract a window shade.

BACKGROUND OF THE INVENTION

A conventional window shade generally is lifted or lowered through a rope. The rope is exposed outside and could cause a hazardous condition by tangling or strangling children playing nearby. Hence for safety reason, the rope of the window shade is generally collected in a winding device located on the bottom rail of the window shade without exposing to prevent risks.

There are many types of pulling cord winding devices for window shades on the market. FIG. 1 illustrates one of the examples (namely U.S. Pat. No. 6,024,154). It has a pulling cord winding device A installed on a bottom rail B1. The device includes a cord braking board A1 which has two S-type winding sets C installed on two side. The S-type winding sets C are mounted onto two corresponding winding struts C1 and C2. The winding strut C1 located on the inner side is engaged with a gear A11 which in turn is engaged with a gear rack A10. Engagement between the gear A11 and the gear rack A10 could go awry and result in slipping of the gear A11 caused by pulling of a pulling cord C3 while the window shade B is extended or retracted. Moreover, the crest A110 of the gear A11 is prone to be hit by the gear rack A10 on a specific spot and result in wearing (as shown in FIG. 2). This could make anchoring of the pulling cord C3 difficult. Furthermore, because the pulling cord winding device A contains two S-type winding sets C on the two sides of the cord braking board A1, it has too many elements and becomes too bulky. The bottom rail B1 must have a bigger size to accommodate the device. In short, the entire device takes too much space and is too costly. The enlarged bottom rail B1 also becomes too heavy. And the spring installed inside the pulling cord winding device A has to withstand a greater force. This shortens the service life of the device.

FIG. 3 shows another conventional pulling cord winding device disclosed in U.S. Pat. No. 6,575,223 B1. The winding device E is installed in a bottom rail D1 of a window shade D. It includes a cord braking board E1 which has two corresponding cams E2 on two sides. Each cam has latch troughs E20. A pressing plate E3 is located between the two cams E2 that has two latch arms E4 to latch on the cams E2 (referring to FIG. 4A). When the window shade D is extended or retracted, the latch arms E4 tend to slide under the impact of external forces. As a result, coupling between the latch arms E4 and the latch troughs E20 is not secured. Hence the window shade D is difficult to be positioned and anchored as desired during extension or retraction (referring to FIG. 4B).

SUMMARY OF THE INVENTION

In view of the aforesaid disadvantages occurred to the conventional winding devices that cannot be anchored as desired during extension and retraction, and are bulky and costly, and increase the weight of the bottom rail, the primary object of the present invention is to provide a pulling cord winding apparatus for window shades that is lighter and has a smaller thickness to reduce the forces exerted on the spring in the pulling cord winding apparatus. The invention is compact and may be easily installed on the bottom rail of the window shade.

The pulling cord winding apparatus for window shades of the invention includes an upper cap and a lower seat that are coupled together, two elastic take-up reels mounted on holding struts located in a center housing compartment formed on the lower seat, an elastic coil housed in each elastic take-up reel that has two latch ends latched thereon, an elastic reed bridged a post on one side of the housing compartment and a brake element, and a push rod interposed between two brake elements. The push rod is coupled with a ramming element on one side that may be pushed to press the two brake elements to enable the elastic coils to be retracted or released thereby to extend or retract the window shade.

Another object of the invention is to form a latch slot on the anchor strut and a retaining member on an inner perimeter of the elastic take-up reel that has a latch trough to allow the two latch ends of the elastic coil to wedge in so that the two elastic coils are held and latched in the two elastic take-up reels.

Yet another object of the invention is to form a coarse outer surface on the brake element to increase the friction to harness the elastic take-up reel. Through the elastic reed which bridges the post and the brake element, and forward pressing and backward retracting of the ramming element on one end of the push rod to retract or press the brake elements so that the two elastic take-up reels also are released or pressed, the elastic coils are retracted or released to enable the window shade to be extended, retracted and anchored, and the two elastic take-up reels also are pressed by the coarse surface of the brake elements to be anchored while the window shade is extended to the extreme end.

Still another object of the invention is to allow the elastic coils to be wound in the housing space of the elastic take-up reel to provide a returning torsional force to automatically retract the window shade.

The foregoing, as well as additional objects, features, and advantages of the invention will be more readily apparent from the following detailed description, which proceeds with reference to the accompanying drawings.

DETAILED DESCRIPTION OF THE PREFERRED EMBODIMENTS

Figure 1:
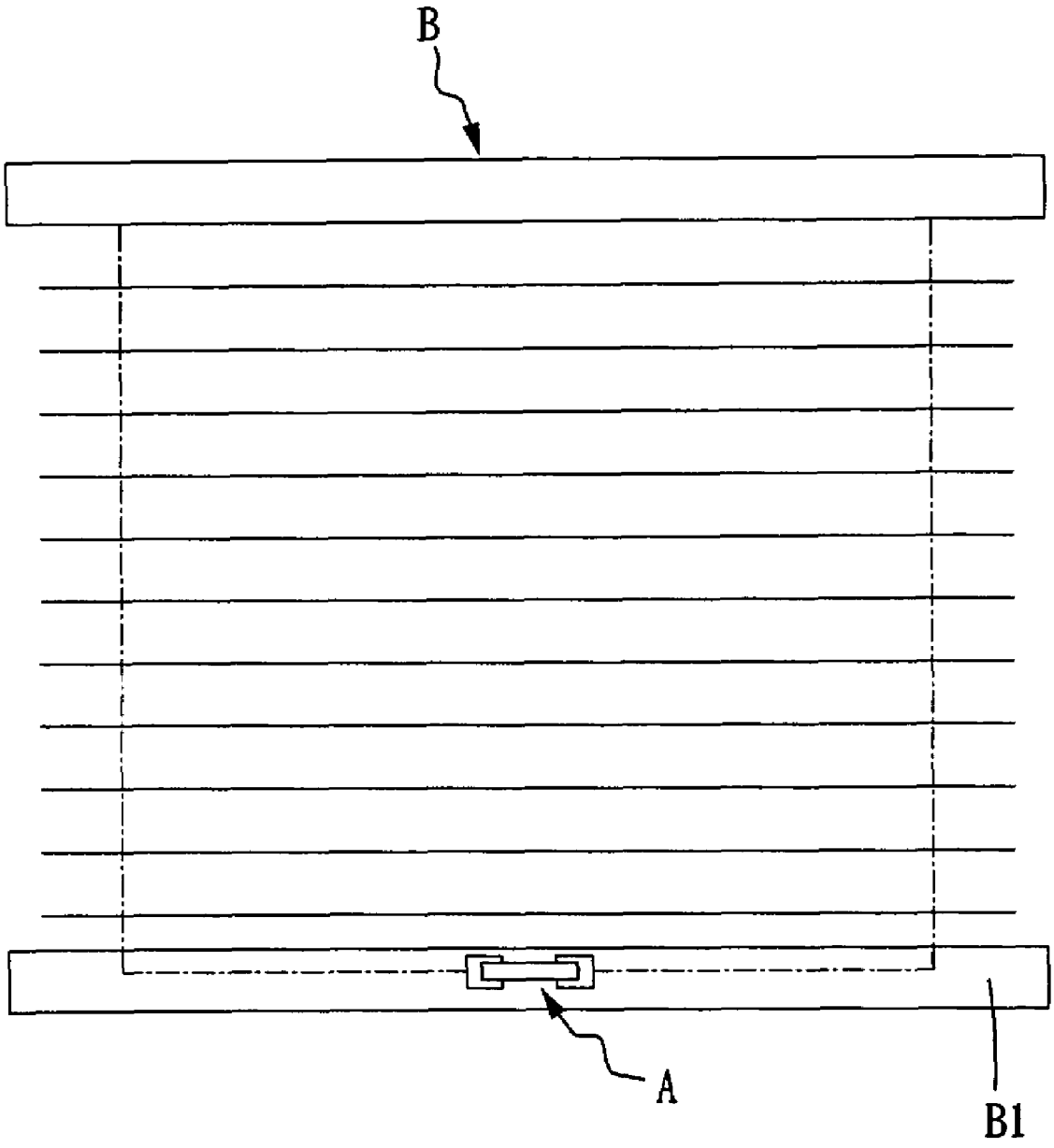
Fig. 1 PRIOR ART
FIG. 1 is a front view of U.S. Pat. No. 6,024,154.
Figure 2:
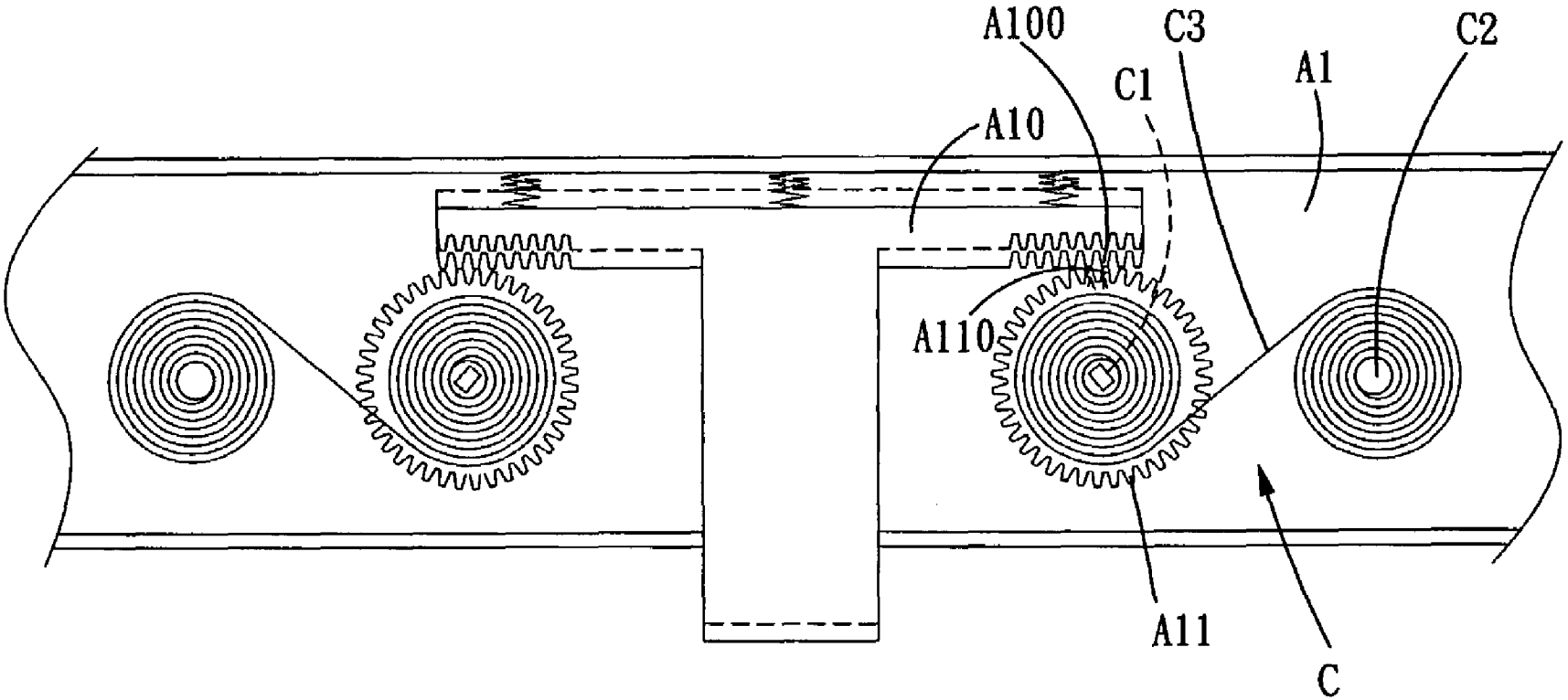
Fig. 2 PRIOR ART
FIG. 2 is a schematic view according to FIG. 1 showing the gear rack and the gear in a coupling condition.
Figure 3:
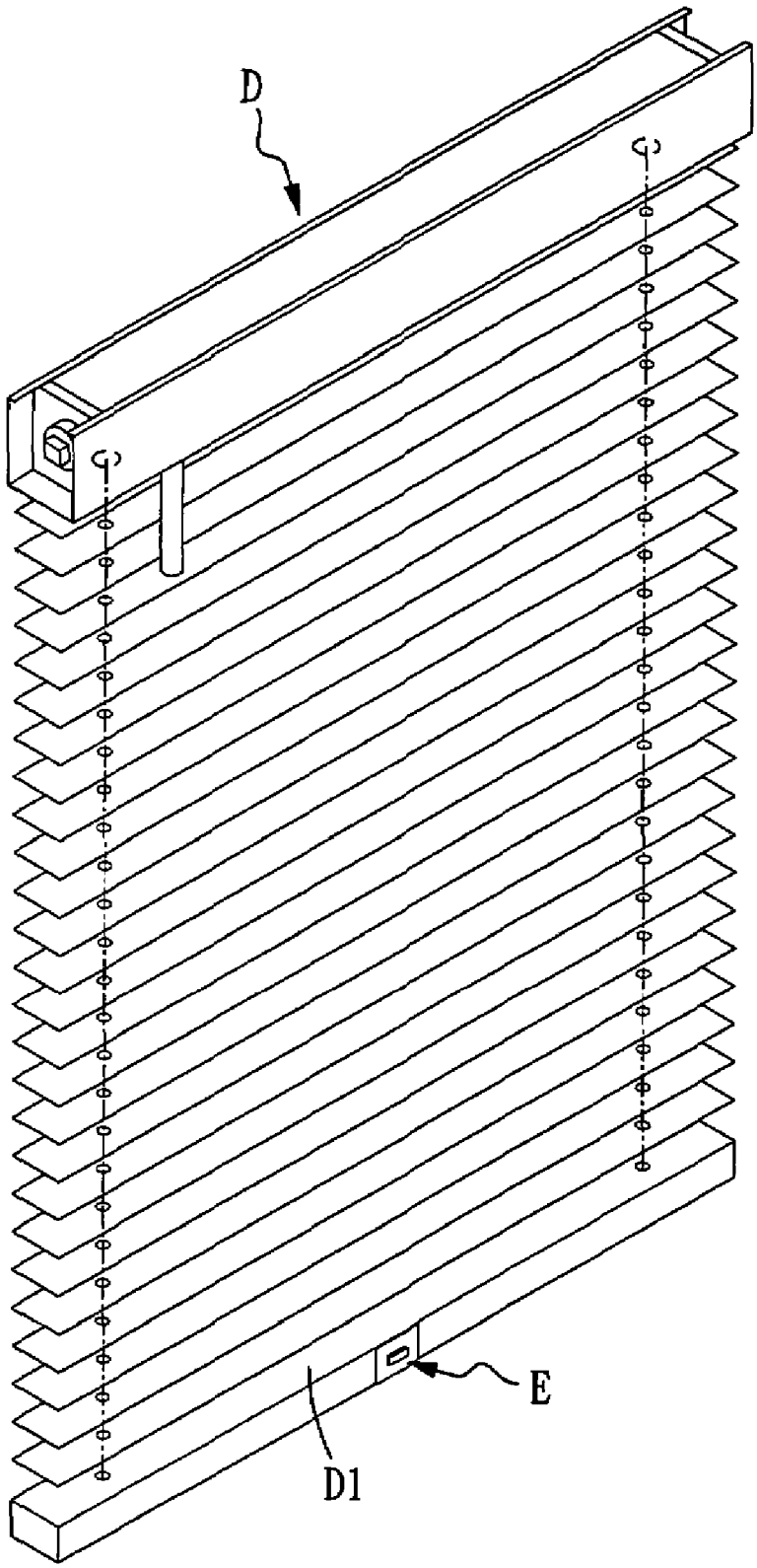
Fig. 3 PRIOR ART
FIG. 3 is a perspective view of U.S. Pat. No. 6,575,223 B1.
Figure 4A:
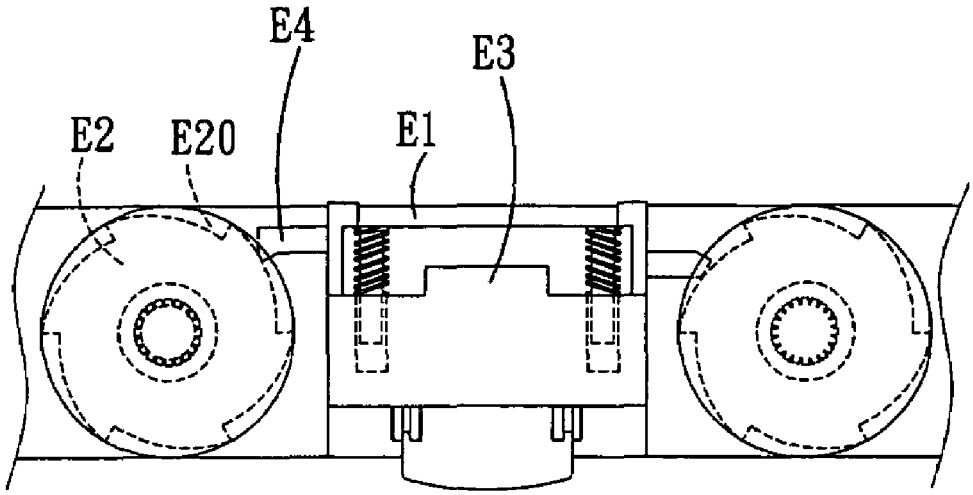
Fig. 4A PRIOR ART
FIG. 4A is a schematic view according to FIG. 3 showing the latch trough of the cam and the latch arm in a latch condition.
Figure 4B:
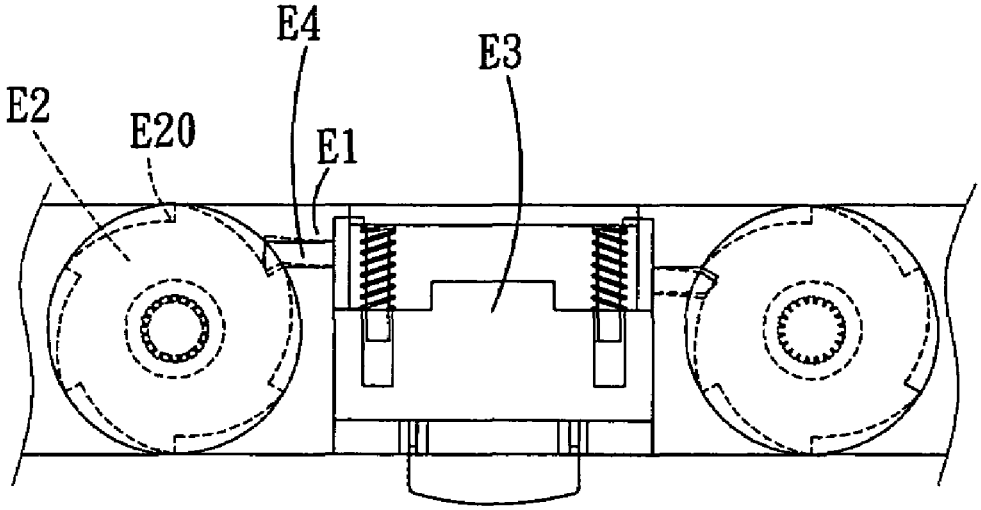
Fig. 4B PRIOR ART
FIG. 4B is a schematic view according to FIG. 3 showing the latch trough of the cam and the latch arm in a unlatch condition.
Figure 5:
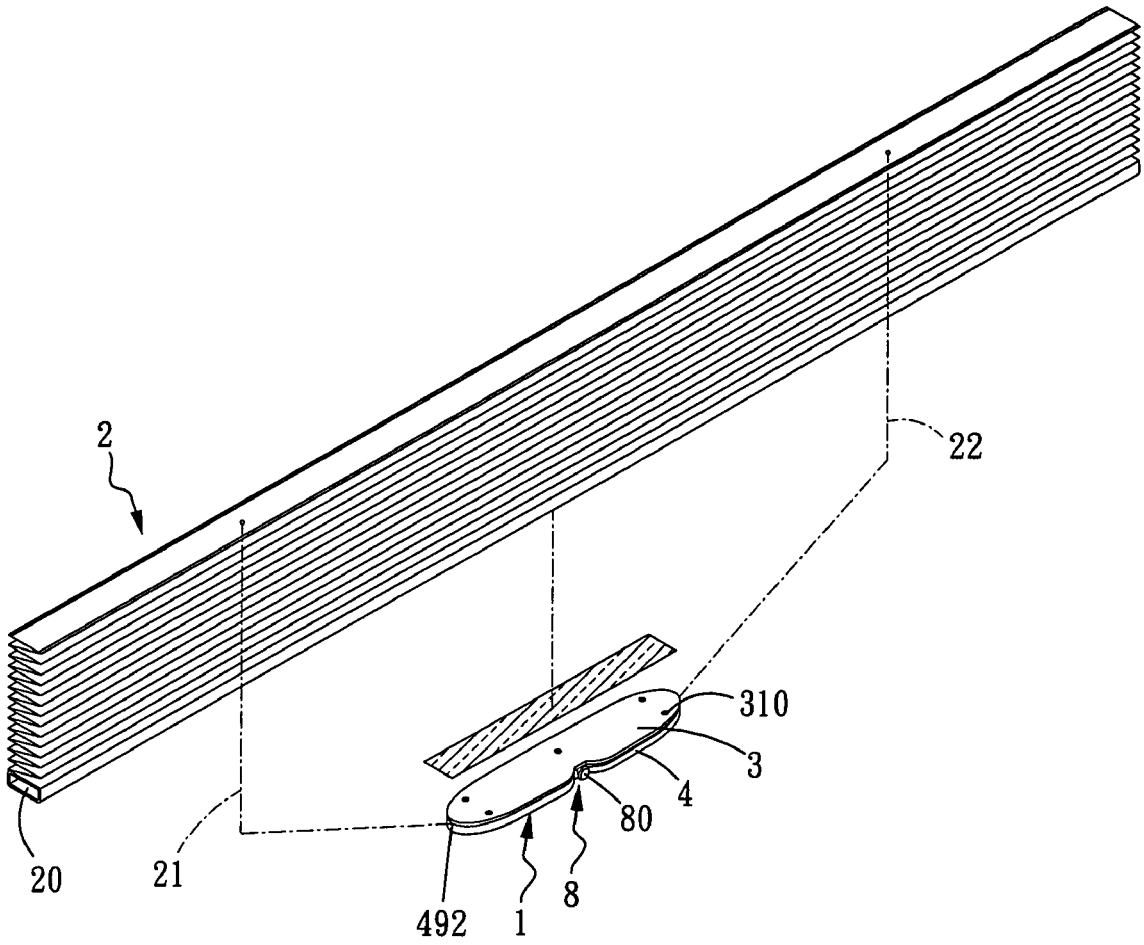
FIG. 5 is an exploded view of the present invention.
Figure 6:
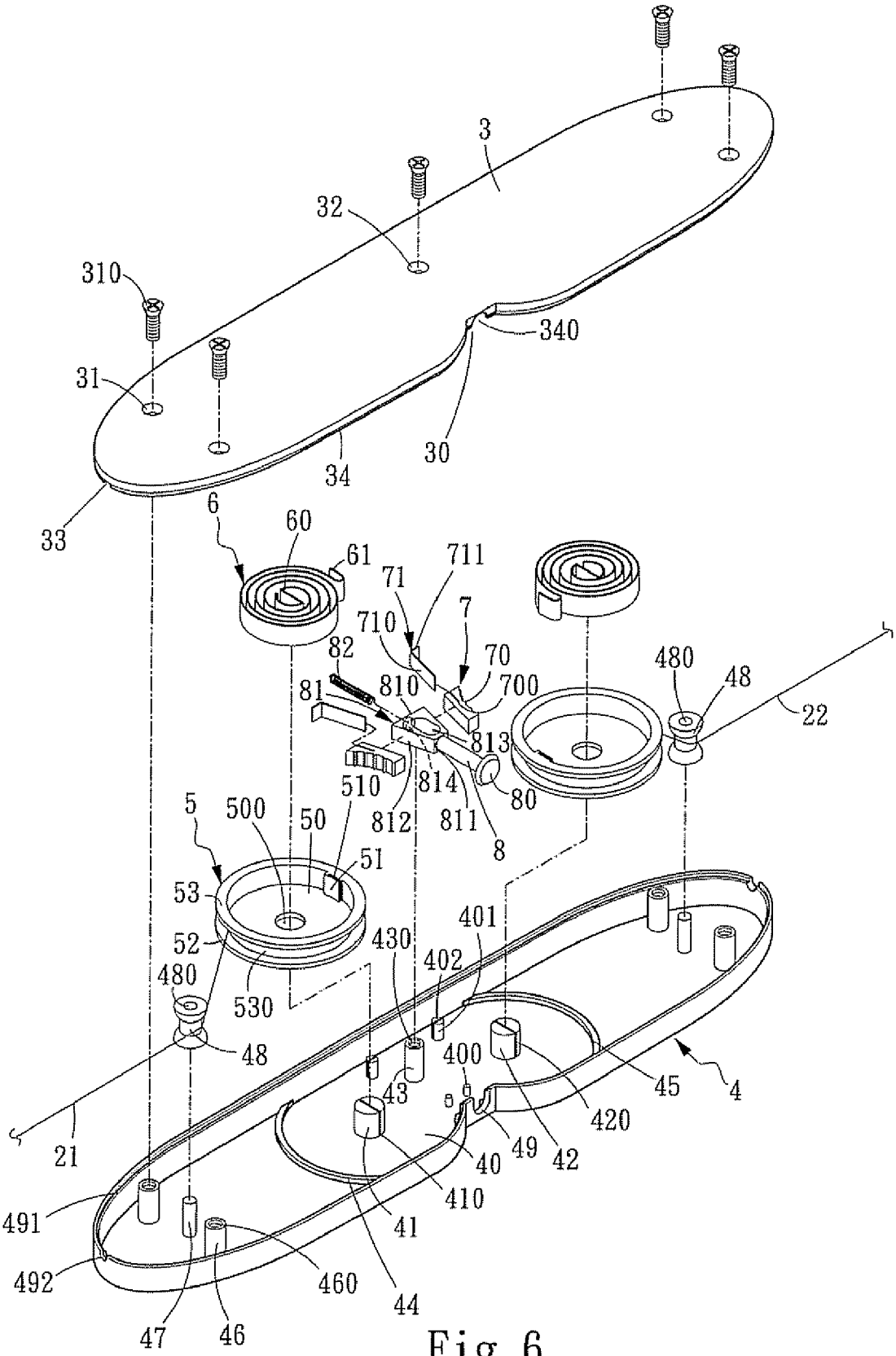
FIG. 6 is an exploded view of the winding apparatus of the present invention.

Please refer to FIGS. 5 and 6 for the basic structure of the pulling cord winding apparatus according to the present invention. The pulling cord winding apparatus 1 is installed in a bottom rail 20 of a window shade 2 to wind and house pulling cords 21 and 22 on two sides of the window shade 2. The pulling cord winding apparatus 1 includes an upper cap 3 and a lower seat 4 that are coupled together, two elastic take-up reels 5 corresponding to two holding struts 41 and 42 located in a center housing compartment 40 of the lower seat 4, two elastic coils 6 having two latch ends 60 and 61 housed and latched in the elastic take-up reels 5, an elastic reed 71 bridged a post 43 on one side of the housing compartment 40 and a brake element 7, and a push rod 8 interposed between two brake elements 7 to form a forced contact with the brake elements. The push rod 8 is coupled with a ramming element 81 on one side. When the push rod 8 is depressed or retracted, the ramming element 81 is moved to press the two brake elements 7 to enable a coarse surface 70 formed on an outer side of the elastic coils 5 to be separated from, or press on the two elastic take-up reels 5 to form a braking or turning condition, and the two elastic coils 6 also are retracted or released to extend or retract the window shade 2.

The upper cap 3 is an elongate member with a recess 30 in the center of a front end, and sunk holes 31 and 32 on two sides and one side of the center, and a contact side 33 which has a wedge flange 34 on a front end and a rear end. The wedge flange 34 on the front end has a concave notch 340 in the center.

The lower seat 4 is formed in a shape mating the upper cap 3, and has the center housing compartment 40, bucking struts 400 on the front end and the rear end, wedge struts 401 that have a first wedge slot 402, and the two holding struts 41 and 42 on two sides. The holding struts 41 and 42 have respectively a latch slot 410 and 420. The post 43 is located on one side in the center between the two holding struts 41 and 42, and has a screw hole 430 corresponding to the sunk hole 32. On the outer side of the two holding struts 41 and 42, there are two arched retaining flanges 44 and 45. The lower seat 4 further has fastening struts 46, and each of them has a screw hole 460 corresponding to the sunk hole 31. Between two fastening struts 46, there is a strut 47 to couple with an axle hole 480 of a guide reel 48. The lower seat 4 also has a concave notch 49 and a recess 491 mating the concave notch 340 and wedge flange 34 of the upper cap 3, and two apertures 492 on two sides to allow the pulling cords 21 and 22 to pass through to extend and retract the window shade 2.

The two elastic take-up reels 5 have respectively a housing space 50, an opening 500 in the center of the bottom to couple with the holding struts 41 and 42. On the inner perimeter of the housing space 50, there is a jutting retaining member 51 which has a latch trough 510. The two elastic take-up reels 5 further have respectively flanges 52 and 53 extended from two sides to form a winding zone 530 in the middle to wind the pulling cords 21 and 22.

The two latch ends 60 and 61 of the two elastic coils 6 are latched respectively on the latch slot 410 and 420 of the holding struts 41 and 42, and the latch trough 510 of the retaining member 51 of the elastic take-up reels 5.

The brake element 7 is elongated and diagonal with the coarse surface 70 formed on an outer side. It has a second wedge slot 700 on one end to hold a long end 710 of the elastic reed 71. The elastic reed 71 has a short end 711 to latch in the first wedge slot 402 of the wedge strut 401 so that the brake element 7 and the post 43 are bridged by the diagonal elastic reed 71.

The push rod 8 has a depressing head 80 on one end and the ramming element 81 on other end. The ramming element 81 has a wide edge 810 on one end and a narrow edge 811 on another end, two sloped edges 812, and a slot 813 in the center. The wide edge 810 has a cavity 814 to hold a spring 82. The push rod 8 is located between the two brake elements 7.

For assembly, wind the pulling cords 21 and 22 on the two elastic take-up reels 5 in the winding zone 530; couple the opening 500 with the holding struts 41 and 42 of the lower seat 4 with the latch ends 60 and 61 of the elastic coils 6 latched respectively in the latch slots 410 and 420 of the struts 41 and 42, and the latch trough 510 of the retaining member 51; place the push rod 8 between the two brake elements 7; insert the spring 82 into the cavity 814 of the ramming element 81; wedge the long end 710 of the elastic reed 71 in the second wedge slot 700 on one end of the brake element 7, and wedge the short end 711 in the first wedge slot 402 of the wedge strut 401; place one end of the brake elements 7 in contact with the upper side of the bucking struts 400; place the push rod 8 in the concave notch 49 of the lower seat 4; couple the wedge flange 34 of the upper cap 3 with the corresponding recess 491 of the lower seat 4; screw fastening elements 310 through the sunk holes 31 and 32 into the corresponding screw holes 460 of the fastening struts 46, and the screw hole 430 of the post 43 to finish the assembly of the pulling cord winding apparatus 1. Install the pulling cord winding apparatus 1 on the bottom end of the bottom rail 20 of the window shade 2; thread the two pulling cords 21 and 22 from two sides of the window shade 2 into the apertures 492 on two sides of the lower seat 4 and wind the pulling cords in the winding zone 530. The pulling cord winding apparatus 1 thus formed has a smaller thickness and is lighter. It can reduce the force exerting on the spring 82 inside the winding apparatus. The pulling cord winding apparatus 1 is compact and may be installed easily on the bottom end of the bottom rail 20 of the window shade 2.

Figure 7:
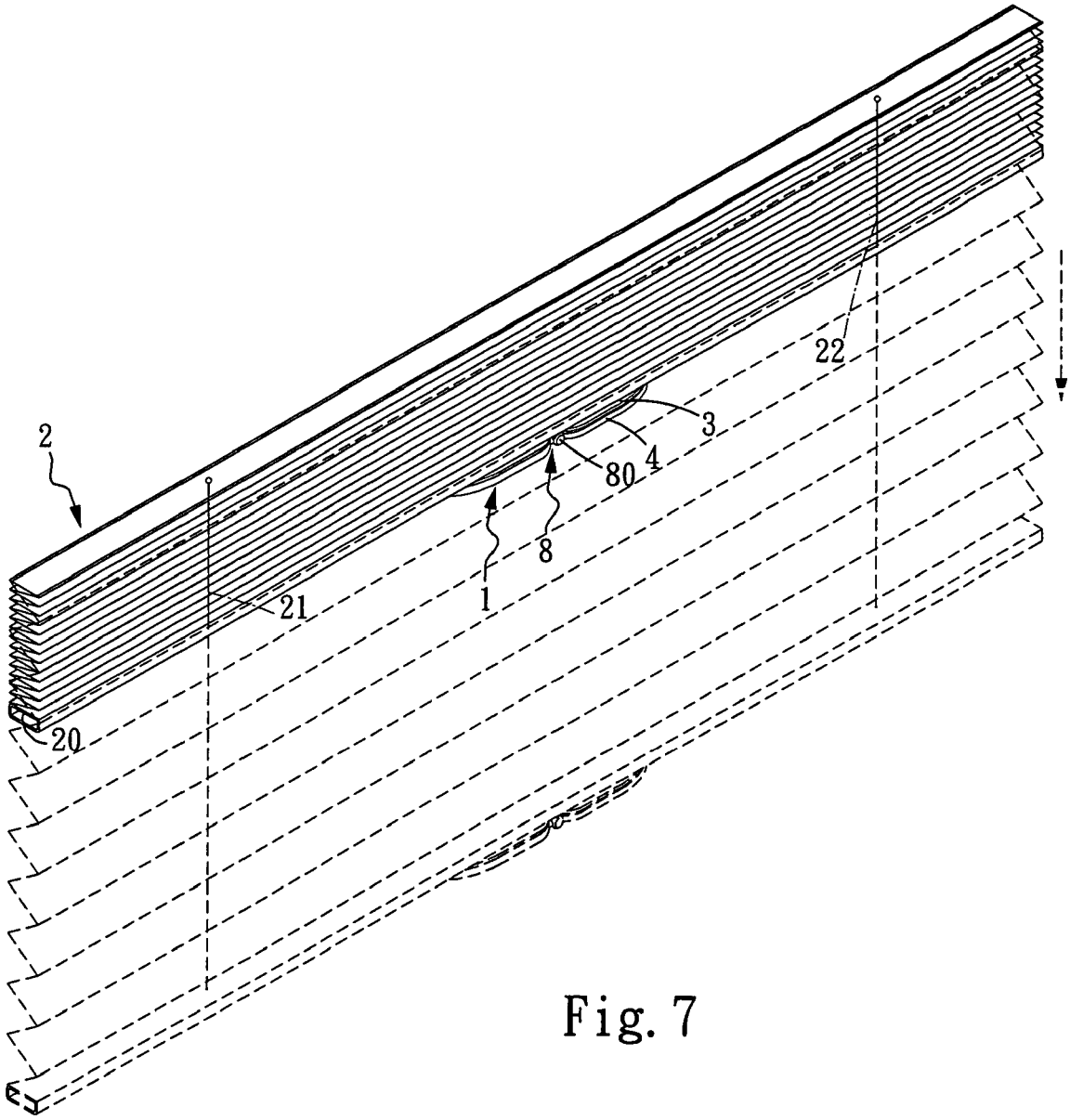
FIG. 7 is a schematic view of the present invention with the window shade in an extended condition.
Figure 8A:
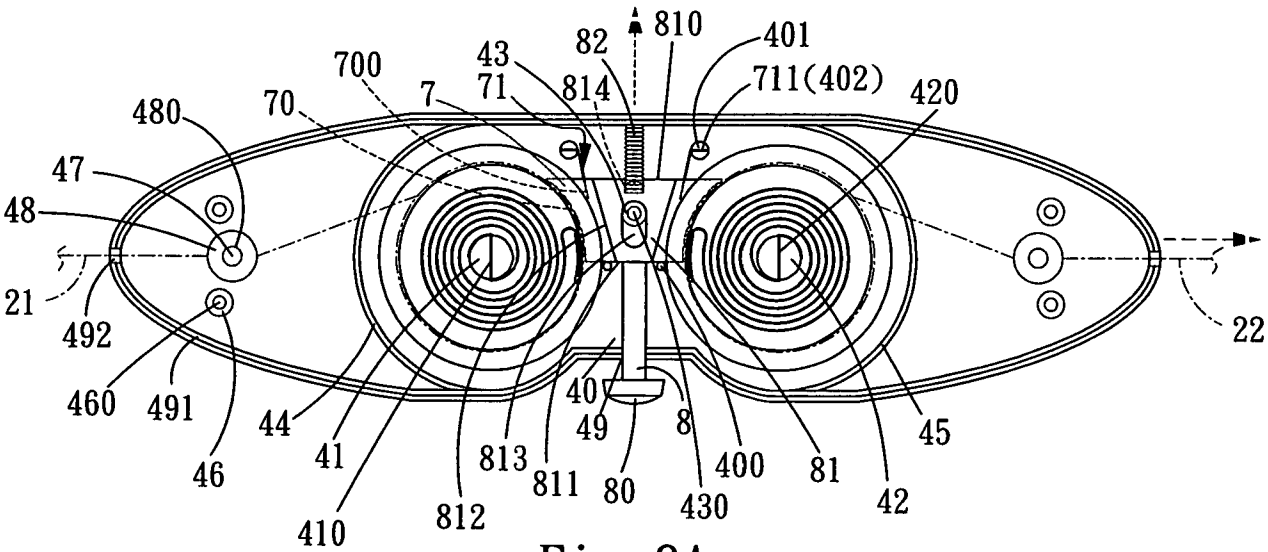
FIGS. 8A and 8B are top views of the pulling cords on two sides of the winding apparatus in an extended condition.
Figure 8B:
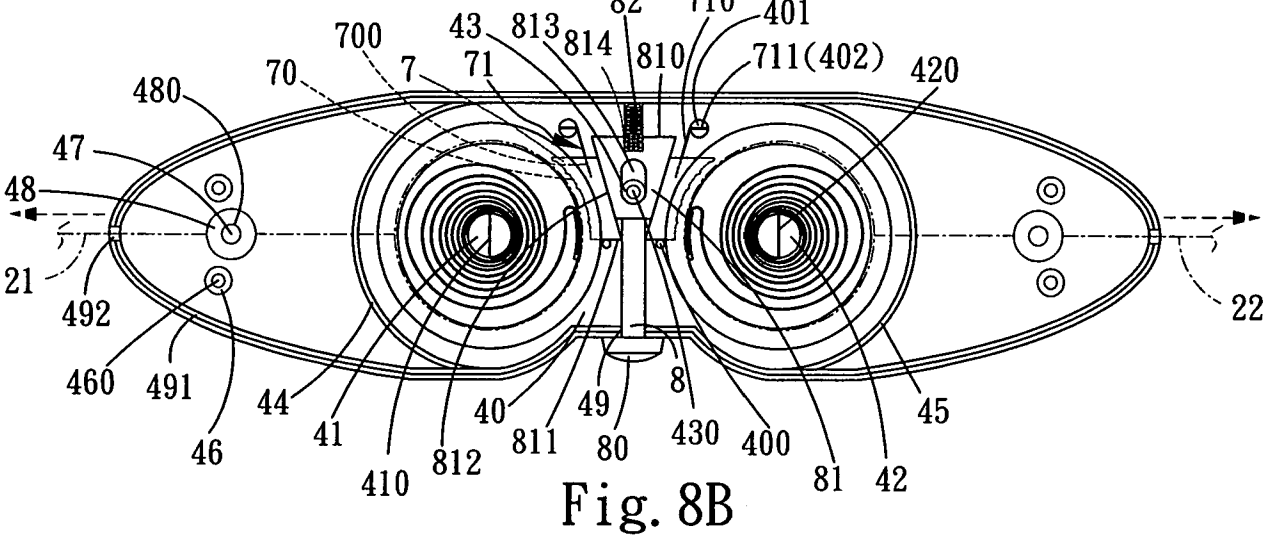

Referring to FIGS. 7, 8A and 8B, when in use, push (or pull) the depressing head 80 of the push rod 8, the ramming element 81 with the spring 82 held in the cavity 814 also is moved rearwards; the sloped edges 812 of the ramming element 81 do not press the brake elements 7, and the coarse surfaces 70 are spaced from or compressed on the pulling cords 21 and 22 wound on the winding zone 530, thus the two elastic take-up reels 5 can rotate and perform braking function. The two elastic coils 6 also are retracted or released to lift the window shade 2 upwards in a retracted manner or lower the window shade 2 in an extended manner. To stop the extension or retraction of the window shade 2, release the depressing head 80 of the push rod 8, the ramming element 81 is braked by the two brake elements 7, and the pulling cords 21 and 22 are retained without generating an extra or not adequate length and creating gaps, hence the brake elements 7 can function normally to enable the window shade 2 to be extended or retracted at a desired elevation.

Figure 9:
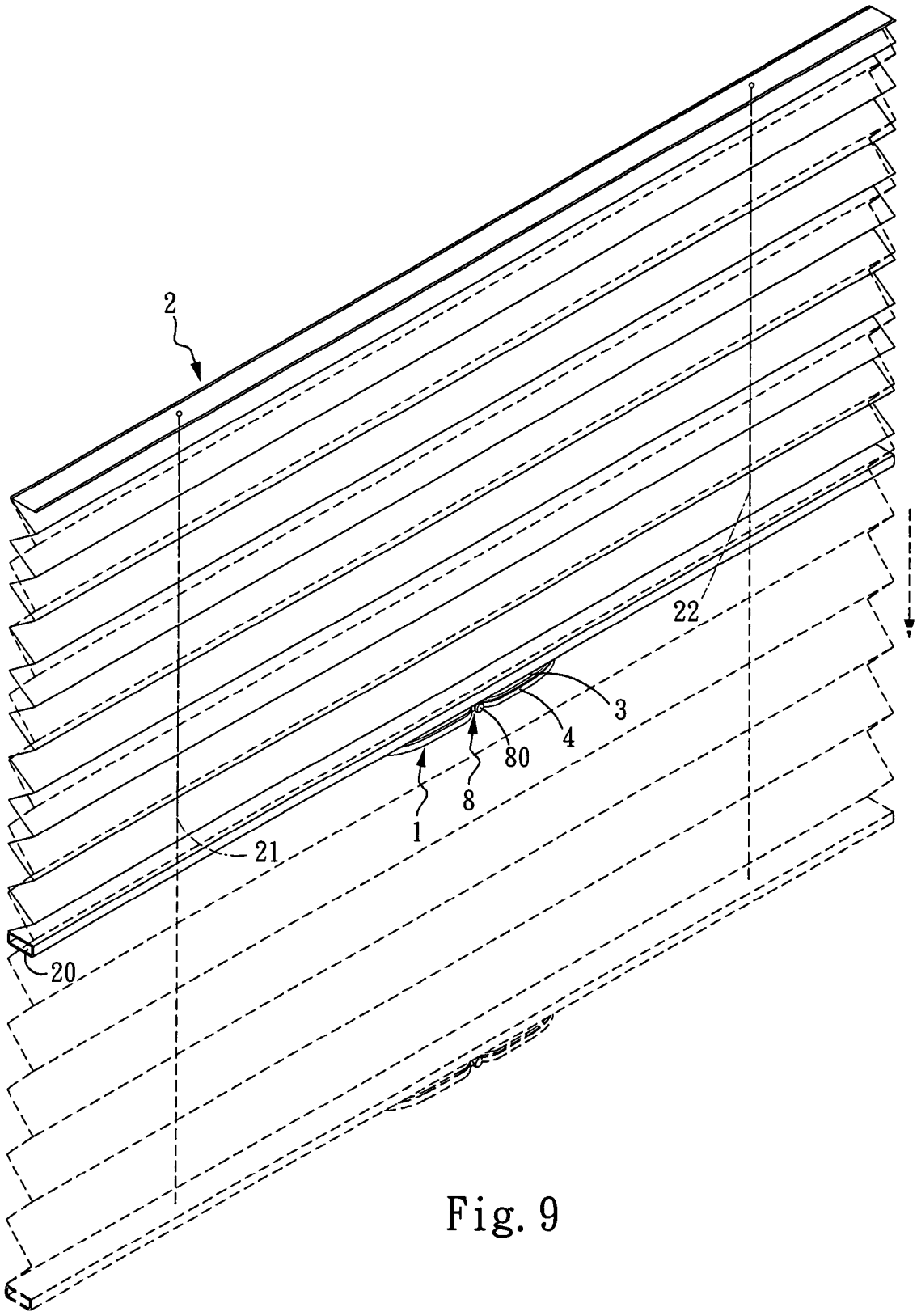
FIG. 9 is a schematic view of the window shade extended to the bottom end.
Figure 10:
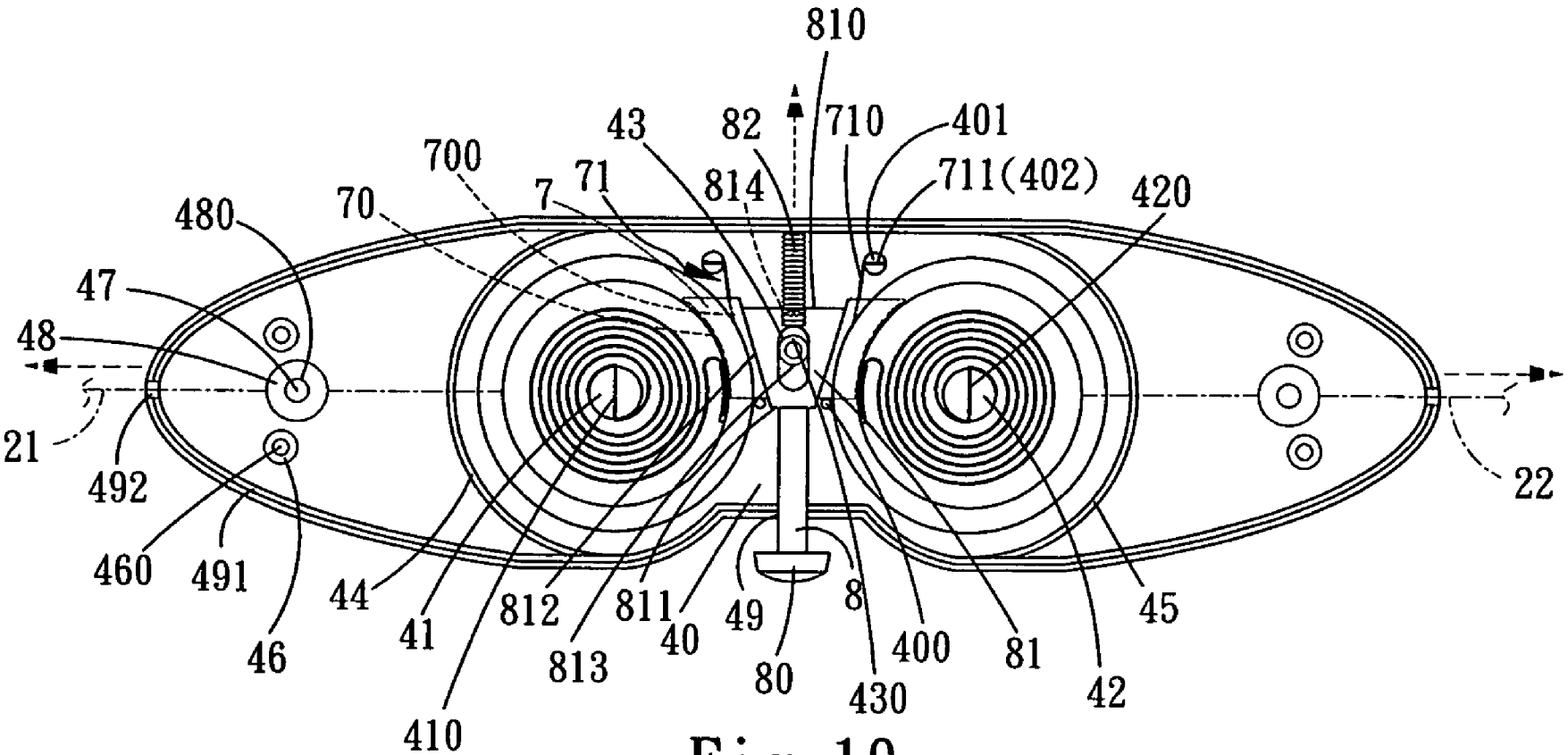
FIG. 10 is a top view of the elastic take-up reels pressed by the coarse surface of the brake elements.

Referring to FIGS. 9 and 10, when the window shade 2 is fully extended, the pulling cords 21 and 22 in the winding zone 530 also are pulled out to the ends, the friction between the winding zone 530 and the coarse surface 70 of the brake elements 7 increases to form an anchoring effect so that the two elastic take-up reels 5 are prevented from slipping.

What is claimed is:

1. A pulling cord winding apparatus for window shades installed on a bottom rail of a window shade to retract and extend pulling cords located on two sides of the window shade, comprising:

an upper cap and a lower seat that are coupled together;

two elastic take-up reels corresponding to holding struts located in a center housing compartment formed on the lower seat;

two elastic coils held in the elastic take-up reels having two ends latched on the elastic take-up reels;

a pair of elastic reeds on opposing sides of a post located on one side of the lower seat and each reed is connected to a respective one of two brake elements; and a push rod located between the two brake elements to form a forced contact therewith;

wherein the push rod is depressible and retractable to move a ramming element on one end thereof to press the brake elements to allow a coarse surface formed on an outer side of the brake elements to he spaced from the two elastic take-up reels to form a braking or rotating condition and allow the two elastic coils to retract or extend to extend or retract the window shade to a selected location.

2. The pulling cord winding apparatus of claim 1, wherein the upper cap is elongated and has a recess in the center of a font end, sunk holes on two sides and on one side of the center, and a contact side which has wedge flanges on a front end and a rear end.

3. The pulling cord winding apparatus of claim 2, wherein the wedge flange on the front end has a concave notch in the center.

4. The pulling cord winding apparatus of claim 1, wherein the lower seat mates with the upper cap.

5. The pulling cord winding apparatus of claim 4, wherein the lower seat has bucking struts and wedge struts on a font end and a rear end of the center housing compartment, the holding struts on two sides, the post between the two holding struts, arched retaining flanges on two outer sides of the holding struts, fastening struts abutting outer sides thereof that have a screw hole, a strut between the fastening struts, a concave notch corresponding to the concave notch of the upper cap, recesses on a font end and a rear end corresponding the wedge flanges of the upper cap, and two apertures on two sides.

6. The pulling cord winding apparatus of claim 5, wherein the wedge struts have a first wedge slot.

7. The pulling cord winding apparatus of claim 5, wherein the holding struts have a latch slot.

8. The pulling cord winding apparatus of claim 1, wherein each of the elastic take-up reels has a housing space which has an opening in the center on the bottom to couple with the holding struts of the lower seat, the housing space further having a jutting retaining member on an inner perimeter that has a latch trough, the two elastic take-up reels having flanges on two sides to form a winding zone in the center to wind the pulling cords.

9. The pulling cord winding apparatus of claim 1, wherein each of the elastic coils has two latch ends.

10. The pulling cord winding apparatus of claim 1, wherein each of the brake elements is formed in an elongated and diagonal shape and has the coarse surface formed on an arched outer side, a second wedge slot on one end to couple with a long end of the elastic reed, and another end in contact with the upper side of the bucking struts.

11. The pulling cord winding apparatus of claim 10, wherein elastic reed has a short end on other end to connect to the long end in a diagonal maimer.

12. The pulling cord winding apparatus of claim 1, wherein push rod has one end formed a depressing head and another end fastened to the ramming element.

13. The pulling cord winding apparatus of claim 12, wherein ramming element has a wide edge on one end that has a cavity formed thereon and a narrow edge on other end, and two sloped edges.

14. The pulling cord winding apparatus of claim 12, wherein the ramming element has a slot in the center.

* * * * *